US006848598B2

(12) United States Patent
Matthews

(10) Patent No.: US 6,848,598 B2
(45) Date of Patent: Feb. 1, 2005

(54) FLUID DISPENSING APPARATUS

(75) Inventor: Robert Edward Matthews, London (GB)

(73) Assignee: Genosis Limited, Kingston-Upon-Thames (GB)

( * ) Notice: Subject to any disclaimer, the term of this patent is extended or adjusted under 35 U.S.C. 154(b) by 41 days.

(21) Appl. No.: 10/363,410

(22) PCT Filed: Jun. 1, 2001

(86) PCT No.: PCT/GB01/02433

§ 371 (c)(1),
(2), (4) Date: Jun. 19, 2003

(87) PCT Pub. No.: WO02/20713

PCT Pub. Date: Mar. 14, 2002

(65) Prior Publication Data

US 2004/0035891 A1 Feb. 26, 2004

(30) Foreign Application Priority Data

Sep. 4, 2000 (GB) ..... 0021665

(51) Int. Cl.[7] ..... B67D 5/00
(52) U.S. Cl. ..... 222/83.5; 222/86; 222/105; 222/478
(58) Field of Search ..... 222/83, 83.5, 85, 222/86, 88, 105, 478, 481.5, 482, 484

(56) References Cited

U.S. PATENT DOCUMENTS

| | | | | | |
|---|---|---|---|---|---|
| 1,342,299 | A | * | 6/1920 | Shaw | 222/81 |
| 1,360,211 | A | * | 11/1920 | Grim | 222/85 |
| 3,288,332 | A | * | 11/1966 | Etter et al. | 222/80 |
| 3,358,883 | A | * | 12/1967 | Lee | 222/86 |
| 3,655,096 | A | * | 4/1972 | Easter | 222/82 |
| 4,058,121 | A | | 11/1977 | Choksi et al. | |
| 4,177,938 | A | * | 12/1979 | Brina | 222/80 |
| 4,441,631 | A | * | 4/1984 | Hosie | 222/86 |
| 4,637,934 | A | * | 1/1987 | White | 222/83 |
| 4,699,296 | A | * | 10/1987 | Schrock, Jr. | 222/85 |
| 4,781,679 | A | | 11/1988 | Larkin | |
| 4,846,369 | A | * | 7/1989 | Dunstan | 222/86 |
| 4,921,138 | A | * | 5/1990 | Quinn et al. | 222/85 |
| 5,397,303 | A | | 3/1995 | Sancoff et al. | |
| 5,607,081 | A | * | 3/1997 | Levy | 222/83.5 |
| 5,645,536 | A | | 7/1997 | Whisson | |

FOREIGN PATENT DOCUMENTS

| | | |
|---|---|---|
| DE | 36 27 231 | 2/1988 |
| FR | 1 537 831 | 7/1967 |
| GB | 1 484 600 | 9/1977 |

* cited by examiner

*Primary Examiner*—Kenneth Bomberg
(74) *Attorney, Agent, or Firm*—Wenderoth, Lind & Ponack, L.L.P.

(57) ABSTRACT

A fluid dispensing apparatus (10) for dispensing a quantity of fluid (10) from a sealed container (12) onto a device (16) or the like. The apparatus (10) comprises a venting needle (18) having a fluid delivery portion (22) and a contain portion (24), a housing (26), a fluid container (12) contained within the housing (26) and an aperture (28) in the housing (26) for passage of fluid (20) from the container (12) onto a fluid receiving portion (14) of the device (16).

21 Claims, 3 Drawing Sheets

34
18
30
26
1
1

34
18
32
30
12
36
26

34
18
44
24
46
32
30
22
48
20
42
50
12
26
42
28
10

FLUID DISPENSING APPARATUS

The present invention relates to a fluid dispensing apparatus. In particular, the present invention relates to a fluid dispensing apparatus for dispensing a quantity of fluid from a sealed container. Such apparatus is described herein in the context of:

1. Delivering fluid onto a biological sample in a device, for example an assay device, and
2. Delivering fluid onto a pharmaceutical product in the form of a dry solid or a powder or a concentrate or a liquid for hydrating or rehydrating that solid or powder, or for forming a suspension with that solid or powder or for mixing two liquids.

However, it will be appreciated that the apparatus of the present invention is also useful in numerous other applications.

There are many circumstances in which a fluid has to be maintained separate from an area of an apparatus or from another component in that apparatus until another step in the operation of the apparatus has been completed. UK patent application 0003596.4 (Genosis Limited), for instance, discloses a device for separating motile spermatozoa from a sample, in which the sample is initially kept separate from a liquid separation medium. Other conventional strip devices may also require a sample receiving portion to be kept dry until after the sample has been applied.

It would be desirable to maintain a fluid in a sealed, sterile container, for example a bag, a pouch, a capsule or some other vessel, in a testing apparatus. Only once a sample has been provided on the apparatus will the fluid then be released onto the apparatus or the sample, for example so as to initiate a test. Alternatively a solid or powder can be selectively reconstituted or rehydrated, for example, from a dry state. Such applications would include the preparation of drugs, for example, that have to be taken or applied in liquid form, but which need to be stored in powder or dry form.

According to the present invention there is provided a fluid dispensing apparatus for dispensing fluid from a hermetically sealed container, the apparatus comprising a venting needle for venting the fluid from the container, the venting needle comprising a fluid delivery portion and a container venting portion, the container venting portion being distal along the needle of the delivery portion, the delivery portion and the venting portion each defining a channel extending from the respective portion through the sidewall of the needle. The channels allow the delivery portion, in use, to deliver fluid from the container, for example by venting air at one end and dispensing fluid at the other.

Preferably the venting needle is at least partially a cannula having a cannulated point at the delivery portion for controlled, pipette-like delivery.

Preferably the venting needle comprises a proximal portion and a distal portion. The distal portion comprises both the venting portion and the delivery portion of the venting needle.

The two channels are preferably unitary, the channel extending from the venting portion to the delivery portion.

The needle preferably has a push button for use by a user for pressing the venting needle through a container to dispense fluid therefrom. By having the position at which the needle is driven spaced from the delivery portion, the risk of contamination of the fluid by the operator is reduced. A screw-advance mechanism may alternatively be provided.

The needle preferably has a C-shaped section at the venting portion and the delivery portion.

The channel at the delivery portion may be a through channel for alleviating fluid hang-ups by increasing the flow area of the channel.

The needle may have a non-cannulated point, e.g. a taper point.

Towards the point of the needle there may be a step. The step can help to restrain a flap portion of the container, which can be cut in the container material by the needle upon punching the needle through the container. The flap may otherwise tend to fold back into the channel. The through channel also helps in this aspect of the invention since even if the flap does fold back despite the step, the through channel is still unlikely to be blocked.

Preferably, the needle is provided in stainless steel. However, it has been noted that if made from a plastics material, there is more fluid retention than that which would occur in stainless steel. Accordingly, the provision of a through channel is preferable, especially in plastics needles since it allows the fluid to flow more freely.

The container can be a bag, a pouch, a capsule or some other vessel of a size suitable for the volume of fluid to be contained by it. The container can, however, be pierced by the needle.

The fluid dispensing apparatus is preferably for mounting in or on a device for assays or for preparing solutions. For example the device may be an assay device or a pharmaceutical product preparation device. For this, the apparatus preferably comprises a housing, a fluid container contained within a cavity defined by the housing and an aperture in the housing for passage of fluid from the container, for example onto a fluid receiving portion of an assay device. Preferably the cavity retains the fluid container in a fixed position. A cap may be provided for the housing to provide a top of the cavity, the housing defining sidewalls of the cavity. Preferably the cap is snap-fitted on to the housing.

In a preferred embodiment, the apparatus is mounted on a device for assaying sperm. Such a device will typically include a visible label which binds to sperm. The device may be of the type disclosed in WO00/09648, WO00/20866, and/or GB-0003596.4.

Preferably, in use, the venting needle extends through an aperture in the cap.

The housing can be formed of any desired shape, for example circular or square.

Preferably the fluid container is substantially filled with fluid and hermetically sealed. The fluid may be sterile.

Typical fluids contained within the container are buffers (e.g. HEPES, EBSS etc.). The fluid may comprise a compound which enhances the migration of motile spermatozoa into the fluid e.g. cervical mucus [e.g. Keel & Webster (1988) *Fertil. Steril.* 49:138–143], polyacrylamide gel [e.g. Lorton et al. (1981) *Fertil. Steril.* 35:222–225], hyaluronic acid [e.g. Aitken et al. (1992) *J. Androl.* 13:44–54], or a cellulose derivative [e.g. GB-9919370.8 (Genosis Limited)] such as methylcellulose.

Other fluids can include water and other solvents.

In a venting position, the venting needle preferably extends through two wall portions of the fluid container such that the venting portion forms a passage through the first wall portion to allow the container to be vented with air and the delivery portion forms a passage through the second wall portion to allow fluid to be dispensed from the container.

Preferably the housing is sealed other than at its aperture and is provided with at least one passageway circumventing the container within the housing to allow air, or the like, entering the housing through the aperture in the housing to circulate from the aperture, around the container and then to the venting portion of the needle. This allows only that air, or the like, in contact with or surrounding the fluid receiving portion of the device to be used in the venting of the container to allow the fluid to be dispensed from the container.

The housing is usually used in an environment open to the air. However, it can be foreseen that the apparatus of the present invention may be chosen to be used in a sealed environment. Within this sealed environment, however, sufficient air, or the like, will need to be provided to allow the venting of the fluid from the container.

Preferably the fluid container is formed of high density polyethylene (HDPE).

Preferably, in use, the venting apparatus is arranged substantially vertically so that gravity will draw fluid down and out through the delivery portion, through the channel in the delivery portion.

Preferably, the venting needle, in a venting position, extends through a central, upper, concave sidewall of the container for venting and a central nipple or convex lower sidewall of the container for dispensing. By positioning the nipple pointing downwards, fluid within the container, as it is dispensed, will tend to flow to the dispensing portion of the needle due to gravity, thereby allowing the container to be fully emptied without further user interaction.

The needle will be formed of a material of sufficient stiffness and hardness to pierce and push through the wall of the container. For example, for a flexible plastics container, the needle could be formed of an extruded, stiff plastics material.

Preferably the needle is made of a stiff or rigid plastics material or metal. Surgical steels would generally be appropriate. However, almost any rigid materials could be used, subject to its compatibility with the fluid.

The channel of the delivery portion may have a diameter of about 1.5 mm. Different sizes of channel, at either the delivery portion or the venting portion can be provided, however, to control the delivery rate of the fluid from the container. For a more viscous fluid, larger aperture sizes will be required, as would be apparent to a person skilled in the art of fluid dynamics.

A kit of parts comprising the needle, a container, the housing, the cap and a device for assays or pharmaceutical preparation could also be provided.

Preferably the fluid dispensing apparatus dispenses fluid that enables migration of motile spermatozoa. For example the fluid may comprise a compound that enhances migration of motile spermatozoa. Reference is made in this regard to the teachings of the above references.

The present invention will now be described by way of example with reference to the accompanying drawings in which.

Figure 3:
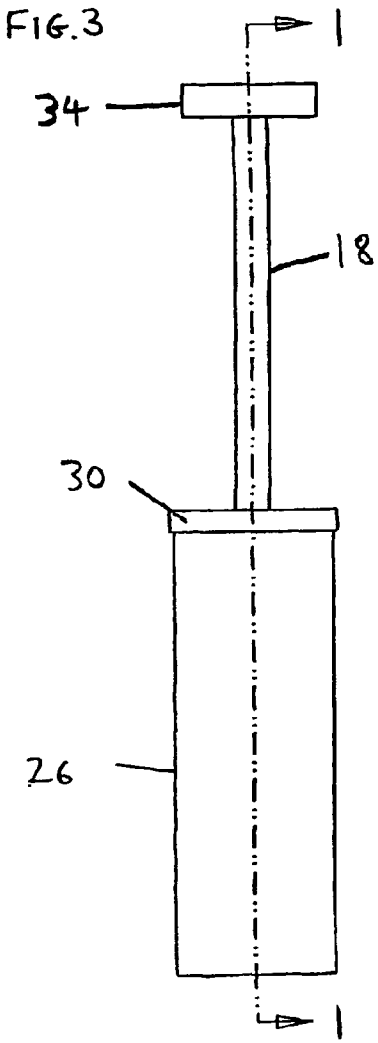
FIG. 3 shows, in elevation, the apparatus of FIG. 1.
Figure 2:
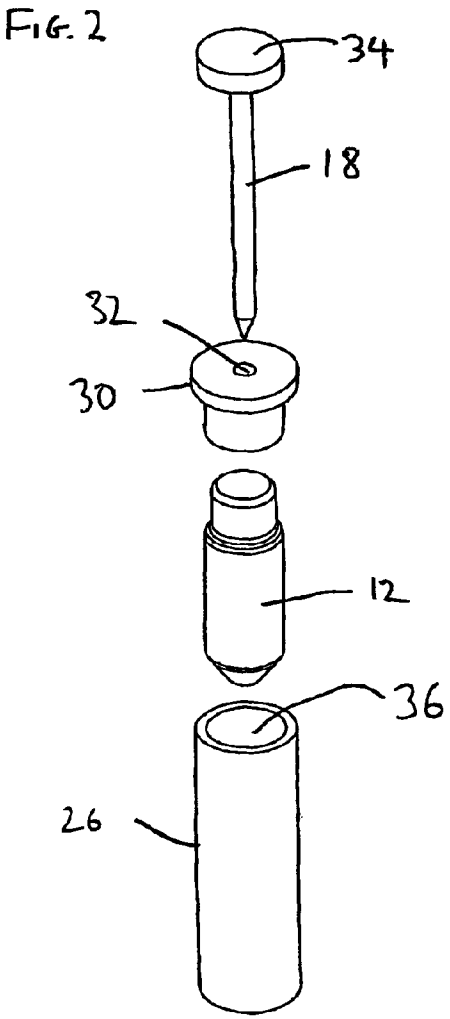
FIG. 2 shows in exploded perspective, the apparatus of FIG. 1.
Figure 1:
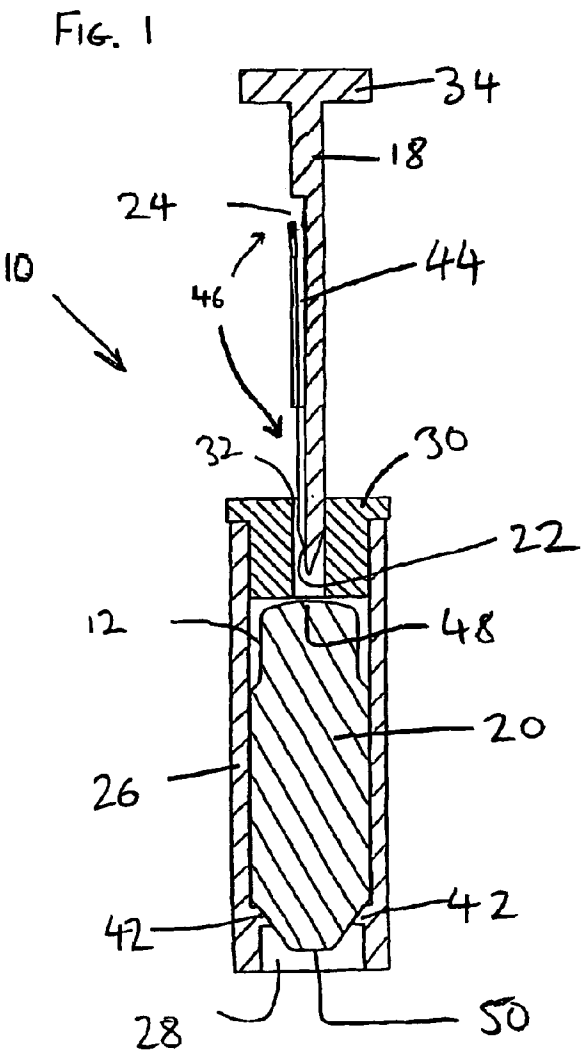
FIG. 1 shows, as section 1-1 of FIG. 3, an apparatus of the present invention prior to dispensing the fluid.

Referring now to FIGS. 1, 2 and 3 of the drawings, there is shown a first embodiment of the present invention. The fluid dispensing apparatus 10 can be mounted directly onto a device for assay or for preparing solutions (not shown) for delivering fluid from a container 12 onto or into the device. The fluid dispensing apparatus 10 comprises a cylindrical housing 26 having a cavity 36 extending therethrough. Within the cavity 36 there is provided a fluid container 12. The diameter of the fluid container 12 is such that its sidewalls rest against the inner walls of the housing 26. The container may be flexible and could be, for example, a bag, a capsule, a vessel or a container.

Towards the lower end of the cavity 36 an aperture 28 is provided. The aperture 28 is bounded by inwardly extending wall portions 42 which prevent the fluid container 12 from falling out of the bottom of the cavity 36 since the bottom end of the fluid container 12 will rest on the wall portions 42.

A cap 30 is provided for sealing the top of the cavity 36. The cap, clearly shown in FIG. 2, comprises an aperture 32 defining a hole extending through the central longitudinal axis of the cap 30 for accepting a venting needle 18. The cap can be otherwise of conventional construction. For example, the cap may snap-fit into the top of the housing. The cap prevents inadvertent removal of the fluid container 12 from within the cavity 36. A removable cap, such as a screw cap, could be provided to allow the apparatus to be refilled and reused.

The final component of the fluid dispensing apparatus 10 is the venting needle 18. The venting needle has a pointed fluid delivery portion 22 at a first end, a container venting portion 24 proximally spaced from the fluid delivery portion 22 and a push button 34 provided on the second end of the needle 18. The push button 34 is spaced further proximally from the fluid delivery portion 22 than the container venting portion 24. The push button 34 has a top surface of conventional shape, suitable for pushing with a finger or thumb of a user.

A channel 44 extends between the fluid delivery portion 22 and the container venting portion 24. The channel 44 breaches the sidewall of the needle 18 at the container venting portion 24 and at the fluid delivery portion 22 (as shown by arrows 46 in FIG. 1).

The apparatus is assembled such that the needle 18 extends through the aperture 32 in the cap 30 to a position adjacent to the top wall of the fluid container 12. The needle 18 can have a tight, sealed fit with the aperture 32, if required. However, venting air is required to circulate to the venting portion 24 of the needle 18 in order for venting of the fluid during delivery to occur. Therefore venting channels (not shown) could be provided surrounding the container 12 between the container outer walls and the housing inner walls. Alternatively, the fit of the container within the housing may be sufficiently loose that air entering the cavity through the aperture 28 can circulate about the container to the container venting portion 24 of the needle 18.

In order to dispense the fluid from within the container 12 through the aperture 28 of the housing, the venting needle 18 must be pushed through the container 12. Initially the point of the fluid delivery portion 22 will pierce the top wall portion 48 of the container 12. As the needle 18 is pushed further through the container 12, it will eventually reach the bottom wall portion 50 of the container 12. The point will then pierce the bottom wall portion 50 and extend through into the aperture 28 of the housing 26. At this position, the container venting portion 24 of the needle 18 will have been positioned at the top wall portion 48 so that the sidewall breaches 46 are positioned 1) to allow venting air to enter the container 12 through venting portion 24, for example along the channel 44, and 2) for channelling the fluid from within the container such that it flows down the channel 44 out of the fluid delivery portion 22 at the point of the needle 18. Under gravity, the fluid 20 will continue to flow from the container to empty the container of fluid.

Once emptied, the needle 18 can be left within the housing. In this manner, the risk of needlesticks will also be minimised since the point of the needle is protected by the housing.

Figure 5:
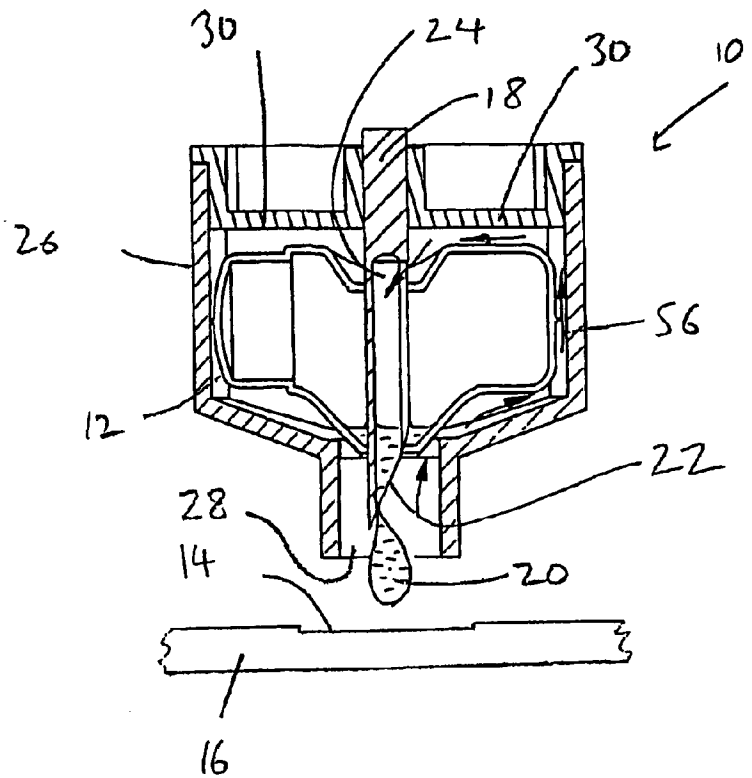
FIG. 5 shows, in section, the apparatus of FIG. 4 dispensing fluid from the container.
Figure 4:
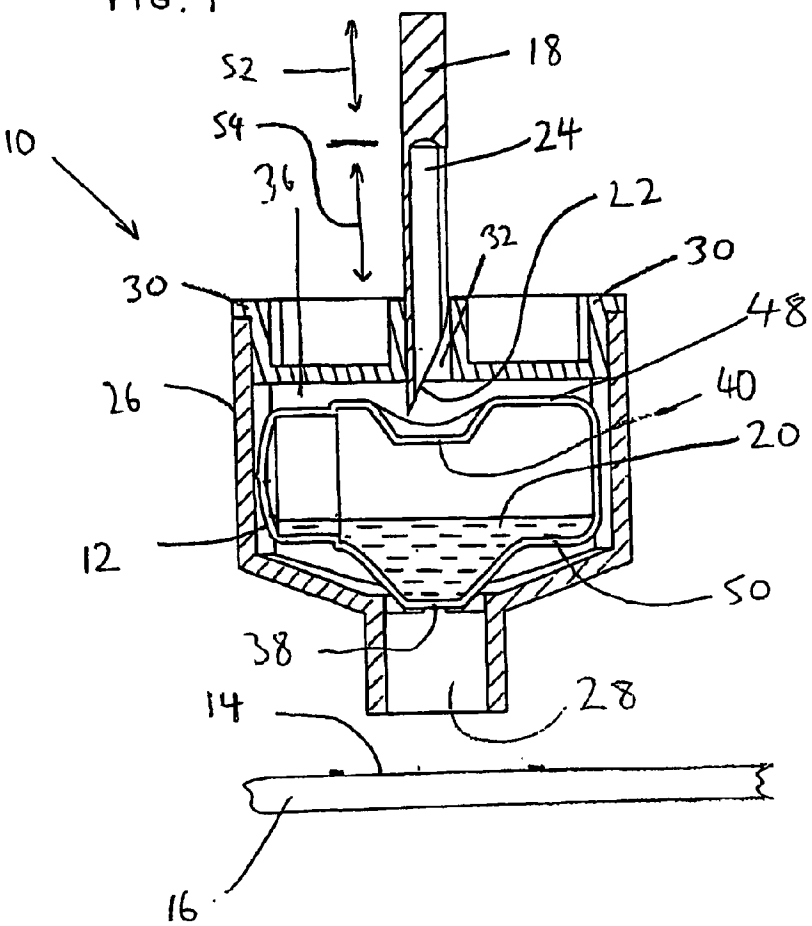
FIG. 4 shows, in section, a second, preferred embodiment of the present invention.
Figure 6:
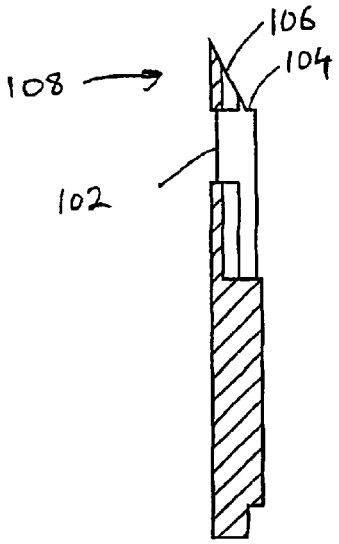
FIG. 6 shows, in section X-X, from FIG. 9, an alternative needle construction, having a partial through channel.

Referring now to FIGS. 4 and 5, a second embodiment of the present invention is shown.

In this embodiment, there is also a venting needle 18, a housing 26 and, a fluid container 12. An aperture 28 is again provided in the base of the housing 26. Fluid 20 is provided within the container 12 and the venting needle 18 comprises the fluid delivery portion 22 and the container venting portion 24.

The operation of the second embodiment is essentially the same as in the first embodiment. However, the shape of the container 12 and the cavity is somewhat different. Instead of the container being elongated in the vertical orientation, as in FIGS. 1–3, the container in the second embodiment is substantially disc shaped. There is a central, upper, concave sidewall 40 arranged in the top wall portion 48 of the container 12 and a central nipple 38, or convex lower sidewall in the bottom wall portion 50 of the container 12. Since the nipple 38 extends downwardly, gravity will cause the fluid 20 within the container 12 to flow into in the nipple for sustained and complete dispensing of the fluid 20 upon venting of the container with the venting needle 18.

In FIGS. 4 and 5, a schematic representation of a device 16, for example an assay device, having a fluid receiving portion 14 is shown. Before dispensing the fluid through the aperture 28 provided in the housing 26, the fluid receiving portion 14 is positioned immediately underneath the aperture 28. As shown in FIG. 5, upon insertion of the needle 18 through the two wall portions 48, 50 of the container 12, the fluid 20 will be dispensed onto the fluid receiving portion 14 of the device 16 since the venting needle allows venting of air or "breathing".

The venting needle 18 shown in FIGS. 4 and 5 has a slightly different construction to that of the first embodiment. In this second embodiment, the needle 18 has two distinct portions. A proximal portion 52 extends from a distal portion 54. The distal portion comprises both the venting portion 24 and the delivery portion 22 of the venting needle 18.

The proximal portion 52 preferably has a solid construction, whereas the distal portion 54 is substantially C-shaped or cannulated. The substantially C-shaped section defines a continuous opening through the sidewall of the distal portion 54 of the venting needle 18. This opening defines a gap in or continuous breaches of the sidewall. Although the gap shown extends along the entire length of the distal portion, it could be closed at certain portions along its length, if desired.

In the second embodiment, the length of the distal portion is such that upon pushing the needle 18 into a dispensing position, as shown in FIG. 5, the distal portion 54 is contained wholly within the housing 26.

The aperture 32 in the cap 30 is sized to engage sealingly the needle 18. Therefore, venting air needs to circulate from the aperture 28 in the bottom of the housing 26, around the container 12 and up to the venting portion 24 of the needle 18. Airflow arrows 56 in FIG. 5 depict this.

Grooves or other passageways (not shown) can be provided on or in the inner wall of the housing 26 to allow the venting air to circulate around the container 12. By using this circulation of air, only that air immediately adjacent or surrounding the sample on the device will be used to vent the fluid from the container 12. Therefore the risk of contaminating either the fluid 20 or the sample provided on the fluid receiving portion 24 is minimised.

A user can push the venting needle 18 in much the same manner as in the first embodiment, shown in FIGS. 1–3. However, no push button is shown in FIGS. 4 and 5. Nevertheless, a push button could be provided for the second embodiment, if required.

Of course, alternative drive means for the venting needle 18 could be provided, as necessary, if required, as would be apparent to a person skilled in the art, dependent upon the type of device being used.

Referring now to FIGS. 6 to 10, there is shown an alternative construction for the needle for use in the present invention. The needle has a channel similar to that described above. However, at the fluid delivery portion of the needle, a through channel 102 is provided. This through channel 102 provides additional flow paths for fluid exiting the container. In metal needles, it has been found that fluid flows readily from a needle, as described previously. However, when made of a plastics material, it is noted that fluid tended to hang-up on the needle in, perhaps, one of every hundred needles tested. Such a failure rate would usually be considered to be unacceptable. By providing the through channel 102, less fluid retention is encountered and therefore fluid will deliver more reliably.

A step 104 is provided on the leading edge 106 of the needle tip 108. This step 104 provides a retaining means to hold a flap (not shown) that can be caused to be cut from the container upon piercing the container with the needle tip 108. This prevents the flap from blocking the fluid delivery portion. However, it should be noted that this step 104 is not necessarily 100% effective. Therefore, the channel also has the through channel 102. Even if the needle becomes blocked by a flap of the container material, the fluid from within the container would still be able to flow through the fluid delivery portion of the needle via the through channel 102.

Figure 7:
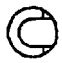
FIGS. 7 and 8 show end views of the needle of FIG. 6.
Figure 8:
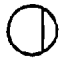
Figure 9:
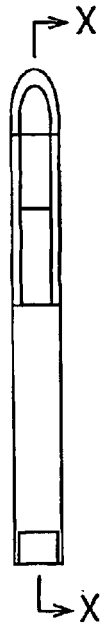
FIG. 9 shows, in elevation, the needle in FIG. 6.
Figure 10:
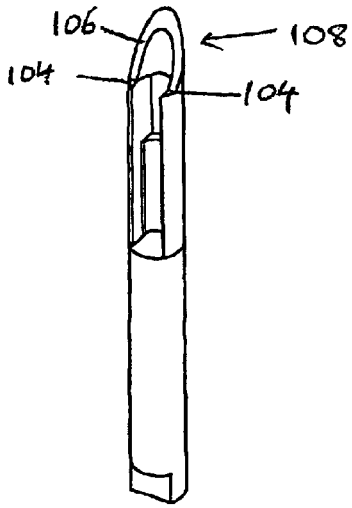
FIG. 10 is a perspective view of the needle of FIG. 6.

By way of an explanation of this feature of the present invention, as shown in FIG. 7 the section of the needle tip 108 is generally C shaped. A cut flap would generally fit within this shape, thereby blocking the channel. By positioning the through channel 102 at the back of the "C", the through channel 102 provides an additional flow path which will be unaffected by the flap. Therefore this helps to prevent the fluid hang-ups.

The base of the channel, which in FIG. 7 is shown to be rounded, may be flat. Such a flat-based channel may be formed into a cylindrical needle blank, for example.

Figure 11:
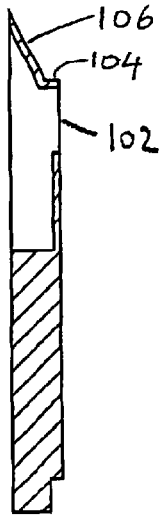
FIG. 11, shows, in section, a further embodiment of a needle in accordance with the present invention.
Figure 12:
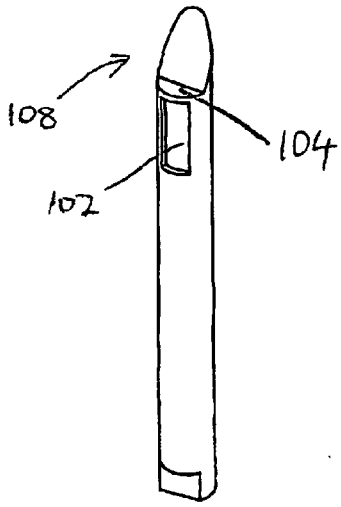
FIG. 12 is a perspective view of the rear side of the needle of FIG. 11.

Referring now to FIGS. 11 and 12, there is shown a further embodiment of needle for use in the present invention. The needle tip 108 of this final embodiment is not cannulated. Therefore there is a form of taper point for the needle. A needle of this design is less likely to cut a flap in the container, thereby reducing the incidence of self-sealing of the container.

A step 104, similar to that of the previously described embodiment, is provided. Further, the through channel 102 is provided.

The orientation of the taper point needle tip relative to the through channel 102 has been reversed in the embodiment of FIGS. 11 and 12 in comparison to the needles of FIGS. 4 to 10. By doing this, the channel length can be maintained at nearly the full length of the needle despite the needle tip not being cannulated.

It is proposed that various other needle shapes and sections could be used that would still provide the necessary fluid flow and delivery requirements of the present invention.

The present invention has been described above purely by way of example. It should be noted, however, that modifications in detail may be made within the scope of the invention as defined in the claims appended hereto.

What is claimed is:

1. A fluid dispensing apparatus (10) for dispensing fluid from a hermetically sealed container (12), the apparatus (10) comprising a venting needle (18) for venting the fluid from the container (12), the venting needle (18) comprising a fluid delivery portion (22) and a container venting portion (24), the container venting portion (24) being distal along the needle (18) of the delivery portion (22), the delivery portion (22) and the venting portion (24) each defining a channel (44) extending from the respective portion through the sidewall of the needle (18);

the fluid dispensing apparatus (10) further comprising a housing (26), a fluid container (12) contained within a cavity (36) defined by the housing (26) and an aperture (28) in the housing (26) for passage of fluid born the container (12) from the fluid delivery portion (22) of the venting needle (18);

characterised in that:

in a venting position, the venting needle (18) extends through the fluid container (12) through two wall portions (48, 50) thereof such that the venting portion (24) forms a passage through the first wall portion (48) to allow the container (12) to be vented and the delivery portion (22) forms a passage through the second wall portion (50) to allow fluid to be dispensed from the container (12).

2. A fluid dispensing apparatus according to claim 1, wherein the housing is sealed other than at its aperture and is provided with at least one passageway circumventing the container within the housing to allow air, or the like, entering the housing through the aperture in the housing to circulate (56) from the aperture (28), around the container (12) and then to the venting portion (24) of the needle (18).

3. A fluid dispensing apparatus according to claim 1, wherein the venting needle, in a venting position, extends through a central, upper sidewall of a fluid container for venting and a central nipple or convex lower sidewall of the container for dispensing.

4. A fluid dispensing apparatus according to claim 1, wherein the venting needle is at least partially a cannula having a cannulated point at the delivery portion.

5. A fluid dispensing apparatus according to claim 1, wherein the venting needle has a non-cannulated point.

6. A fluid dispensing apparatus according to claim 1, wherein the venting needle (18) comprises a proximal portion (52) and a distal portion (54), the distal portion (54) comprising both the venting portion (24) and the delivery portion (22).

7. A fluid dispensing apparatus according to claim 1, wherein the channels are unitary, the channel extending from the venting portion to the delivery portion.

8. A fluid dispensing apparatus according to claim 1, wherein the needle has a C-shaped section at the venting portion and the delivery portion.

9. A fluid dispensing apparatus according to claim 1, wherein the cavity retains the fluid container in a fixed position.

10. A fluid dispensing apparatus according to claim 1, wherein a cap (30) is provided for the housing to provide a top of the cavity.

11. A fluid dispensing apparatus according to claim 10, wherein the cap (30) is snap-fitted onto the housing.

12. A fluid dispensing apparatus according to claim 1, wherein the fluid container is substantially filled with fluid and hermetically sealed.

13. A fluid dispensing apparatus according to claim 1, wherein the needle has a push button (34) for use by a user for pressing the venting needle (18) through the container to dispense fluid therefrom.

14. A fluid dispensing apparatus according to claim 1, wherein the fluid container has an upper sidewall (48) and a convex lower sidewall (50).

15. A fluid dispensing apparatus according to claim 14, wherein the fluid container is substantially disc shaped.

16. A fluid dispensing apparatus according to claim 1, wherein, in use, the venting apparatus is arranged substantially vertically so that gravity will draw fluid down and out through the delivery portion, through the channel in the delivery portion.

17. A fluid dispensing apparatus according to claim 1, wherein the lower sidewall of the container (12) comprises a central downwardly extending nipple (38).

18. A fluid dispensing apparatus according to claim 1, wherein the fluid enables migration of motile spermatozoa.

19. A fluid dispensing apparatus according to claim 1, wherein the channel at the delivery portion is a through channel.

20. A fluid dispensing apparatus according to claim 1, wherein a step is provided in the needle towards the point of the needle.

21. A fluid dispensing apparatus according to claim 1, wherein the needle is formed of a stiff or rigid plastics material.

* * * * *